US011944893B2

(12) United States Patent
Keegan et al.

(10) Patent No.: US 11,944,893 B2
(45) Date of Patent: Apr. 2, 2024

(54) SPORTS BOOT WITH INTEGRATED ANKLE COMPRESSION SYSTEM

(71) Applicant: BOARDRIDERS IP HOLDINGS, LLC, Huntington Beach, CA (US)

(72) Inventors: William Keegan, Burleigh Heads (AU); Giger Ortega, Burleigh Heads (AU)

(73) Assignee: BOARDRIDERS IP HOLDINGS, LLC, Huntington Beach, CA (US)

( * ) Notice: Subject to any disclaimer, the term of this patent is extended or adjusted under 35 U.S.C. 154(b) by 0 days.

(21) Appl. No.: 17/847,882

(22) Filed: Jun. 23, 2022

(65) Prior Publication Data

US 2023/0030523 A1 Feb. 2, 2023

Related U.S. Application Data

(60) Provisional application No. 63/226,365, filed on Jul. 28, 2021.

(51) Int. Cl.

| | |
|---|---|
| ***A63B 71/12*** | (2006.01) |
| ***A43B 5/00*** | (2022.01) |
| ***A43B 7/20*** | (2006.01) |

(52) U.S. Cl.

CPC ..... *A63B 71/1225* (2013.01); *A43B 5/00* (2013.01); *A43B 7/20* (2013.01)

(58) Field of Classification Search

CPC ..... A43B 71/1225; A43B 5/00; A43B 7/20

See application file for complete search history.

(56) References Cited

U.S. PATENT DOCUMENTS

| | | | | |
|---|---|---|---|---|
| 4,583,306 A * | 4/1986 | Paris | ..... | A43B 5/0449 36/118.1 |
| 4,593,483 A * | 6/1986 | Paris | ..... | A43B 5/0427 36/118.1 |
| 4,670,999 A | 6/1987 | Olivieri | | |

(Continued)

FOREIGN PATENT DOCUMENTS

| | | |
|---|---|---|
| CH | 668165 | 12/1988 |
| FR | 2 629 691 | 10/1989 |

OTHER PUBLICATIONS

PCT/US2022/034719, International Search Report and Written Opinion, dated Oct. 18, 2022.

*Primary Examiner* — Bao-Thieu L Nguyen
(74) *Attorney, Agent, or Firm* — NIXON & VANDERHYE P.C.

(57) ABSTRACT

Sport boots have an outer shell and an ankle compression system attached to and positioned within the outer shell to apply selective compressive force against an anterior ankle portion of a person's foot when wearing the boot. The ankle compression system includes an ankle compression member positioned forwardly adjacent to the anterior ankle portion and at least one medial positioning band having a lower terminal end immovably fixed to a medial edge portion of the strobel and having an opposite end operatively associated with the ankle compression member. An adjustment lace is connected to the ankle compression member and is operatively connected to a tightening member positioned on a lateral side of the outer shell so that operation of the tightening causes the adjustment lace to forcibly draw the ankle compression member toward and exert a selective compressive force against the anterior ankle portion of the person's foot.

7 Claims, 16 Drawing Sheets

(56) References Cited

U.S. PATENT DOCUMENTS

| | | | | | |
|---|---|---|---|---|---|
| 4,698,922 | A * | 10/1987 | Sartor | A43B 5/0449 | 36/118.1 |
| 4,937,953 | A * | 7/1990 | Walkhoff | A43B 5/0449 | 36/117.7 |
| 4,942,680 | A * | 7/1990 | Benetti | A43B 5/0449 | 36/118.1 |
| 5,475,935 | A * | 12/1995 | Frost | A43B 7/20 | 36/114 |
| 6,202,953 | B1 | 3/2001 | Hammerslag | | |
| 6,877,256 | B2 | 4/2005 | Martin et al. | | |
| 6,993,859 | B2 | 2/2006 | Martin et al. | | |
| 7,386,947 | B2 | 6/2008 | Martin et al. | | |
| 7,818,899 | B2 * | 10/2010 | Dinndorf | A43B 7/14 | 36/4 |
| 2005/0044749 | A1 * | 3/2005 | Hall | A43B 7/20 | 36/55 |
| 2006/0037215 | A1 * | 2/2006 | Lee | A43B 5/00 | 36/50.5 |
| 2006/0196083 | A1 | 9/2006 | Martin et al. | | |
| 2012/0302933 | A1 * | 11/2012 | Ostergard | A43B 5/00 | 602/27 |
| 2013/0138029 | A1 * | 5/2013 | Gerber | A43B 7/20 | 602/27 |
| 2015/0313318 | A1 * | 11/2015 | Gibb | A43C 7/00 | 36/58.5 |
| 2017/0265590 | A1 * | 9/2017 | Burns | F41C 33/0209 | |
| 2020/0046080 | A1 * | 2/2020 | Burns | A45F 5/02 | |
| 2022/0273075 | A1 * | 9/2022 | MacLeod | A43C 11/165 | |

* cited by examiner

SPORTS BOOT WITH INTEGRATED ANKLE COMPRESSION SYSTEM

CROSS-REFERENCE TO RELATED APPLICATIONS

This application is based on and claims priority benefits from U.S. Provisional Application Ser. No. 63/226,365 filed on Jul. 28, 2021 and entitled "Sports Boot with Integrated Ankle Compression System", the entire content of which is expressly incorporated hereinto by reference.

FIELD

The embodiments disclosed herein relate generally to boots that are used in sports activities, such as hiking, snow shoe activities, skiing, skating, snowboarding and the like. In especially preferred forms, the embodiments disclosed herein are integrally provided with an ankle compression system to allow ease of use and improve the fit and comfort of the boot during use.

BACKGROUND AND SUMMARY

Sports boots, e.g., snowboarding boots, that employ a harness operatively associated with a separable inner liner to allow a user to selectively tighten/loosen the fit of the inner liner are known, for example, through U.S. Pat. Nos. 6,877,256, 6,993,859 and 7,386,947 (the entire contents of each being expressly incorporated hereinto by reference).

While such prior proposals may be satisfactory in certain situations, there is a continued need for sports boots to be provided which include an integrated ankle compression system that allow ease of use and improve the fit and comfort of the boot during use. It is towards fulfilling such needs that the embodiments disclosed herein are directed.

In accordance with the embodiments disclosed herein, sport boots are provided having an outer shell and an ankle compression system attached to and positioned within the outer shell to apply selective compressive force against an anterior ankle portion of a person's foot when wearing the boot. The ankle compression system will preferably include an ankle compression member adapted to be positioned forwardly adjacent the anterior ankle portion and at least one medial positioning band having a lower terminal end immovably fixed to a medial edge portion of the strobel and having an opposite end operatively associated with the ankle compression member. An adjustment lace is connected operatively to the ankle compression member and is operatively connected to a tightening member positioned on a lateral side of the outer shell. The tightening member is thus operable to cause the adjustment lace to forcibly draw the ankle compression member toward and exert a selective compressive force against the anterior ankle portion of the person's foot when wearing the boot.

According to some embodiments, the ankle compression member and the at least one medial positioning band are integrally formed with one another. The ankle compression member may therefore further comprise a lateral positioning band integrally formed with the ankle compression member and laterally extending therefrom and/or the at least one medial positioning band may include upper and lower medial positioning bands. If upper and lower medial positioning bands are provided, a terminal end of the lower medial positioning band may be immovably fixed to the medial edge portion of the strobel while a terminal end of the upper medial positioning band is immovably fixed to an interior portion of the outer shell. Additionally, each of the upper and lower medial positioning bands may an end opposite to the terminal end thereof which is integrally formed with the ankle compression member. The ankle compression member, the upper and lower medial positioning bands and the lateral positioning band may thus be formed as a one-piece generally Y-shaped flexible material structure, wherein a fabric panel may optionally be attached to and between the upper and lower medial positing bands.

The adjustment lace may be operatively connected to a terminal end of the lateral positioning band. In some embodiments, the terminal end of the lateral positioning band may include a U-shaped channel in which the adjustment lace is slideably received.

The ankle compression system of certain embodiments may comprise a lace terminator immovably fixed to an interior portion of the outer shell such that a terminal end of the adjustment lace is attached to the lace terminator. A tube guide may therefore be fixed to an interior portion of the upper shell in spaced relationship above the lace terminator to slideably receive the lace therewithin. According to such embodiments, therefore, a tube may be provided so as to extend between the tube guide and the tightening member for slideably receiving the lace therewithin.

According to other embodiments, opposed medial and lateral positioning bands may be provided with each extending downwardly and rearwardly away from medial and lateral edges of the ankle compression member and terminating in lower terminal ends fixed to medial and lateral edge portions of the strobel, respectively. The medial and lateral positioning straps may therefore include respective upper terminal ends opposite to the lower terminal ends thereof and positioned respectively adjacent to the medial and lateral edges of the ankle compression member. An end of the lace may be fixed to the upper terminal end of the lateral positioning band. Each of the medial and lateral positioning bands may be affixed to an interior portion of the outer shell between the upper and lower terminal ends thereof.

The ankle compression member according to some embodiments may include upper and lower lace channels extending between the medial and lateral edges thereof, the lace being slideably received within the upper and lower lace channels. The lace may therefore be routed through the lower lace channel to the upper terminal end of the medial positioning strap and then doubles back to the upper lace channel at a medial edge of the ankle compression member. The lace may subsequently be routed from the upper lace channel at the lateral edge of the ankle compression member to the tightening member.

Another embodiment of the sport boot according to the herein described invention will include an ankle compression system comprised of an ankle compression member adapted to be positioned forwardly adjacent the anterior ankle portion and including upper and lower generally horizontal guide channels and a rotary tightening mechanism positioned on a lateral side of the outer shell and being accessible from an exterior of the outer shell. An anchor pad fixed to an interior surface of the lateral side of the outer shell below the tightening member is provided such that lower end of an adjustment lace is positionally fixed thereto while an upper end of the adjustment lace is operatively connected to the tightening mechanism. Respective sequential lengths of the adjustment lace between the upper and lower ends thereof are therefore received within the upper and lower guide channels of the ankle compression member such that operation of the tightening mechanism causes the adjustment lace to forcibly draw the ankle compression member toward and exert a selective compressive force against the anterior ankle portion of the person's foot when wearing the boot.

The ankle compression system may comprises an intermediate guide tube positioned on the interior surface of the outer shell between the anchor pad and the tightening member, and/or a U-shaped guide tube fixed to the interior surface of the outer shell on a medial side thereof. The adjustment lace may therefore be routed from the upper end thereof operably attached to the tightening mechanism sequentially through the intermediate guide tube member, the upper guide channel associated with the ankle compression member, the U-shaped guide tube, the lower guide channel associated with the ankle compression member and then to the anchor pad where the lower end of the adjustment lace is positionally fixed.

These and other aspects and advantages of the embodiments of the present invention disclosed herein will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiment in conjunction with the drawings of which:

Figure 8:
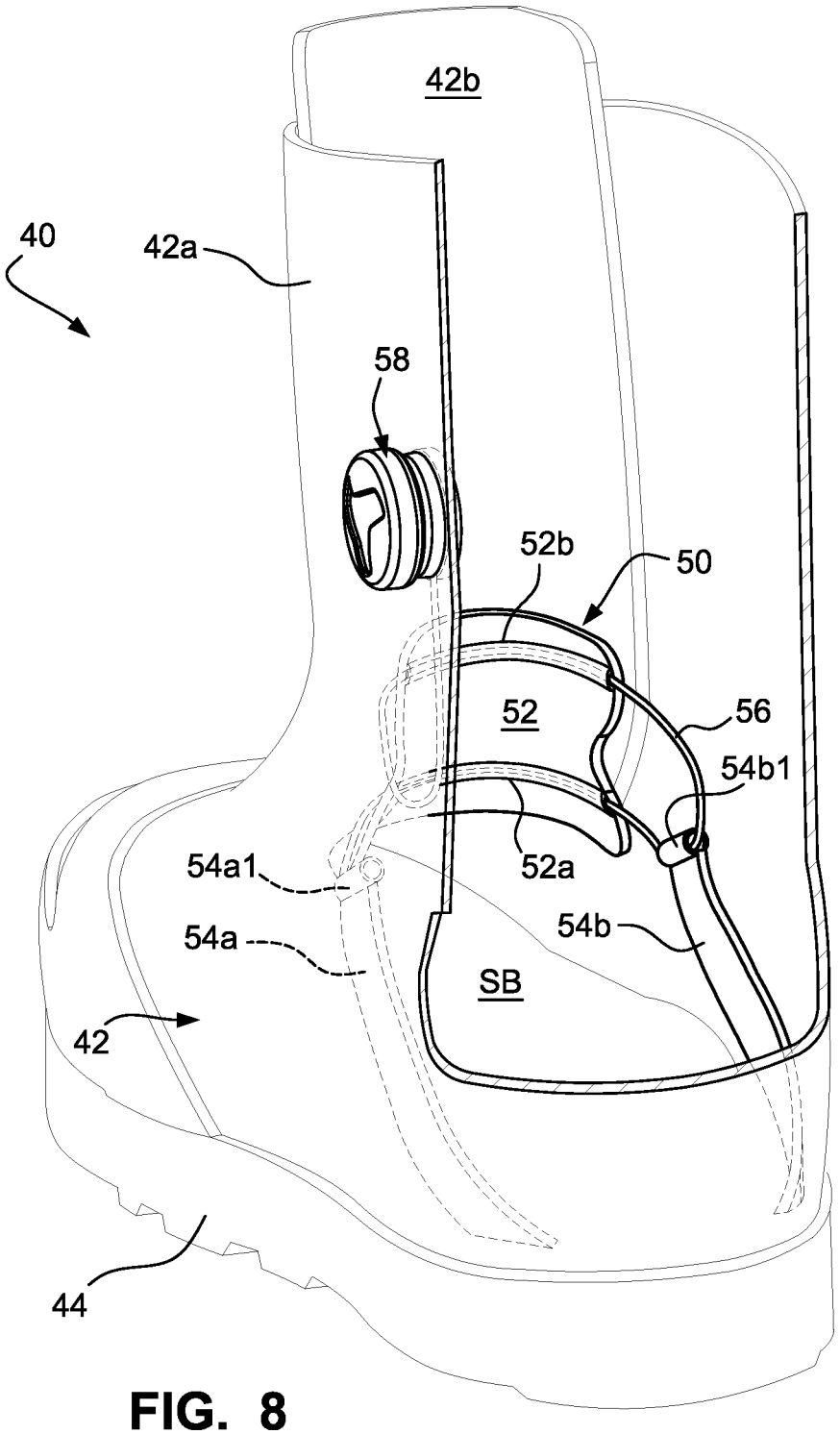
FIG. 8 is a rear perspective view, partly in section, as seen from slightly the lateral side of a sport boot, e.g., a snowboarding boot, showing an outer shell of the boot provided with another embodiment of an integrated ankle compression system according to the invention disclosed herein.
Figure 9:
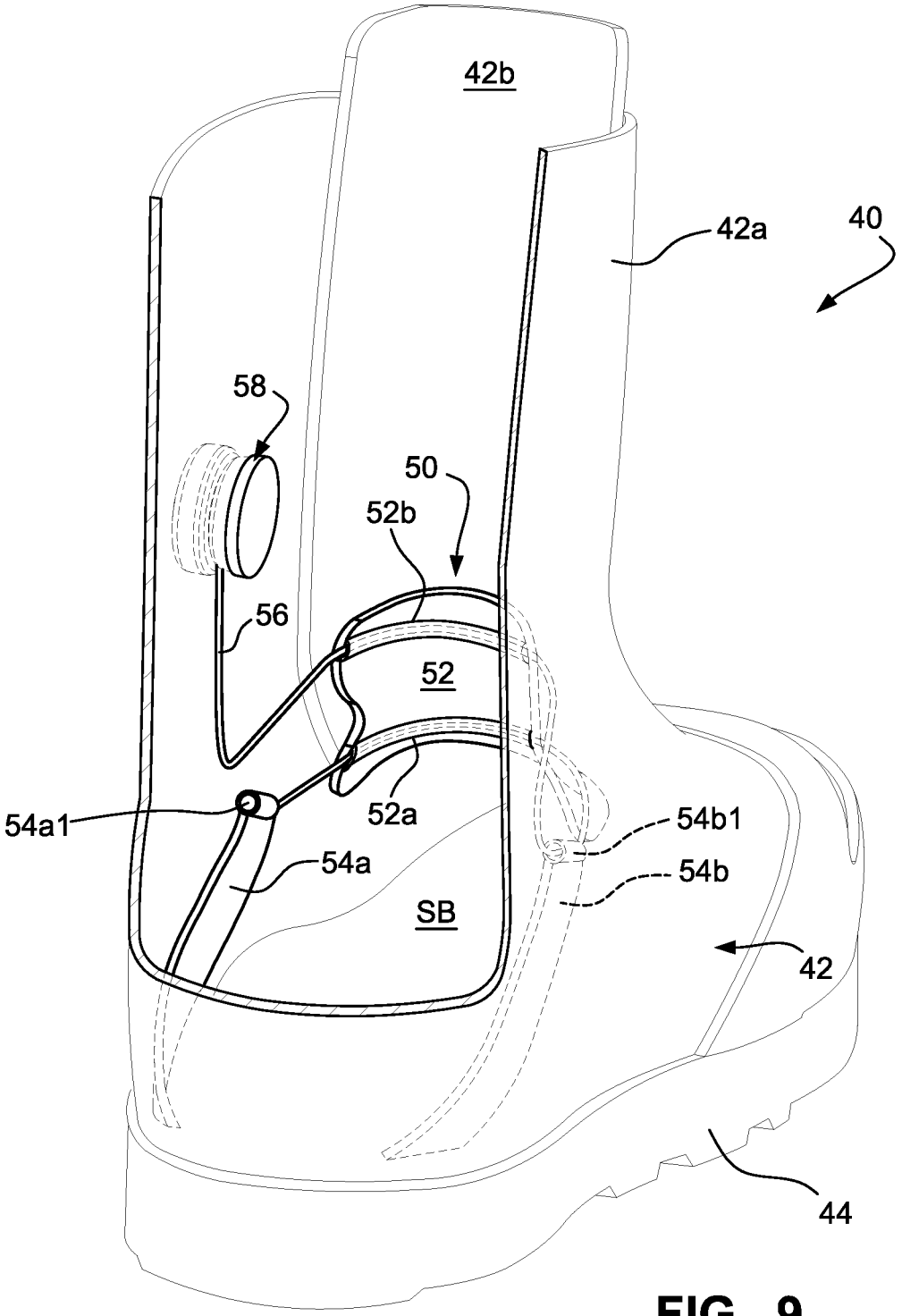
FIG. 9 is a rear perspective view, partly in section, as seen from slightly the medial side of the sport boot depicted in FIG. 8.
Figure 10:
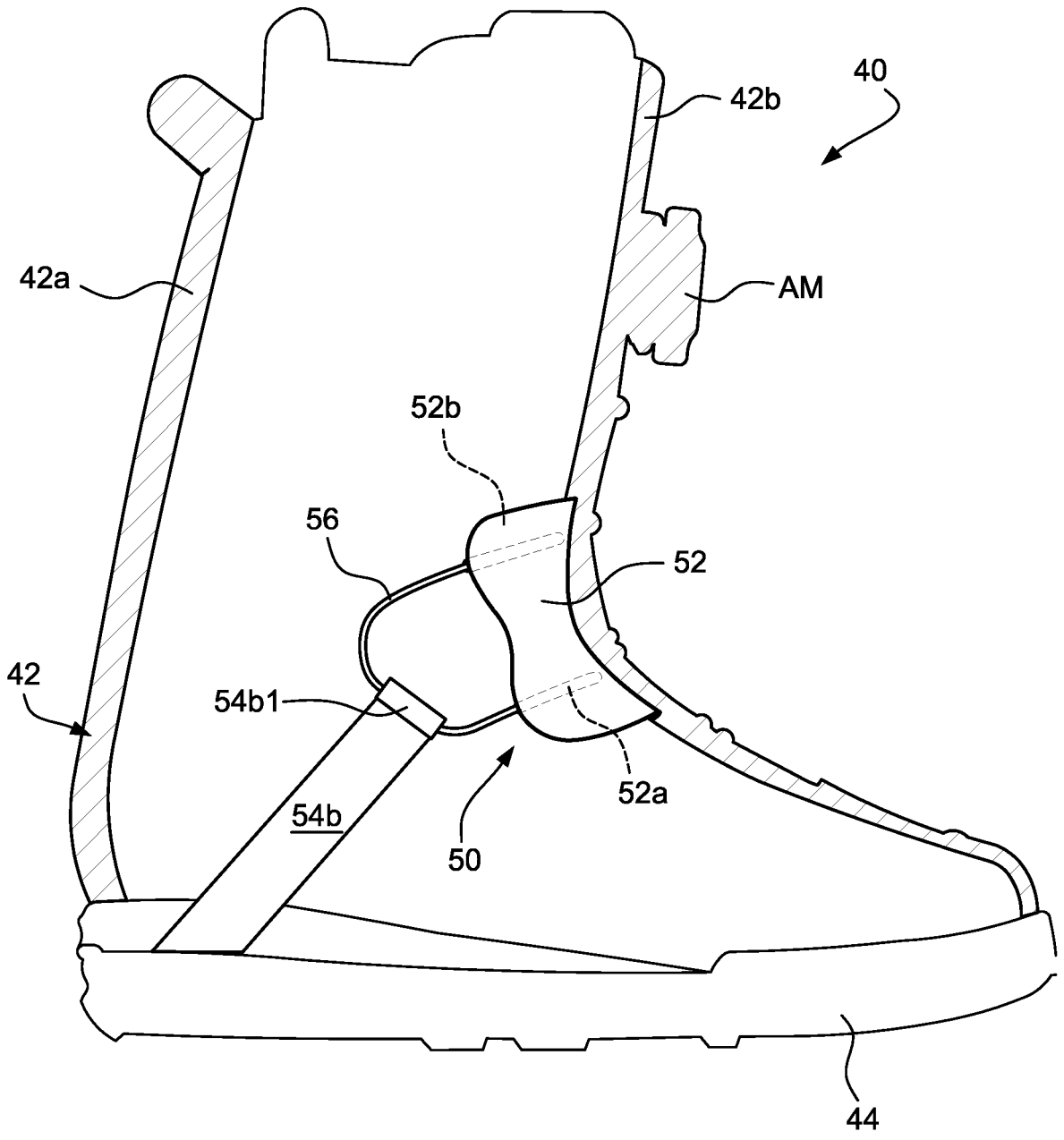
FIG. 10 is a medial side elevational view of the sport boot depicted in FIG. 8 with a portion of the medial outer shell of the boot removed for clarity in showing a medial portion of the integrated ankle compression system thereof.
Figure 11:
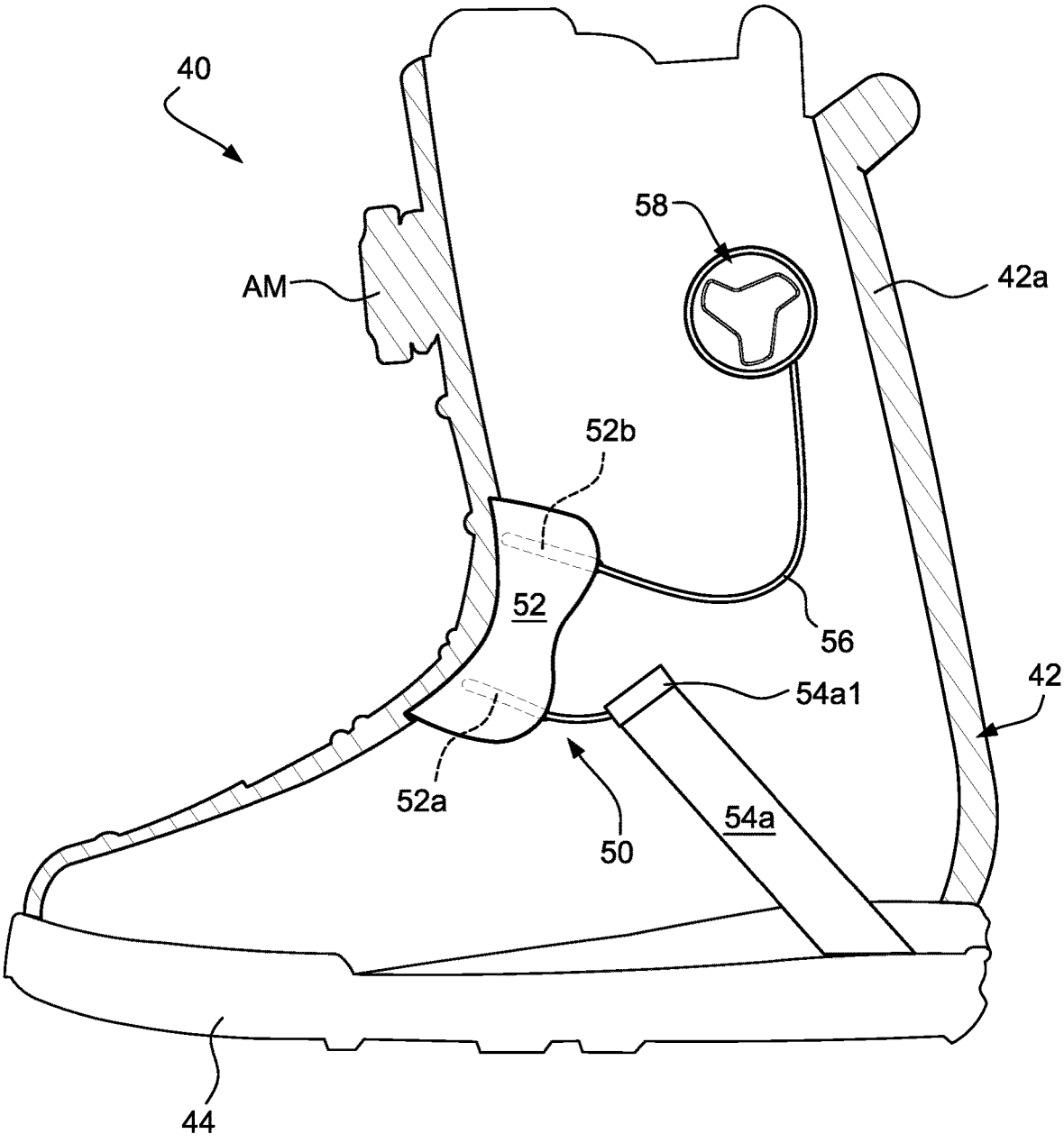
FIG. 11 is a lateral side elevational view of the sport boot depicted in FIG. 8 with a portion of the lateral outer shell of the boot removed for clarity in showing a lateral portion of the integrated ankle compression system thereof.
Figure 12:
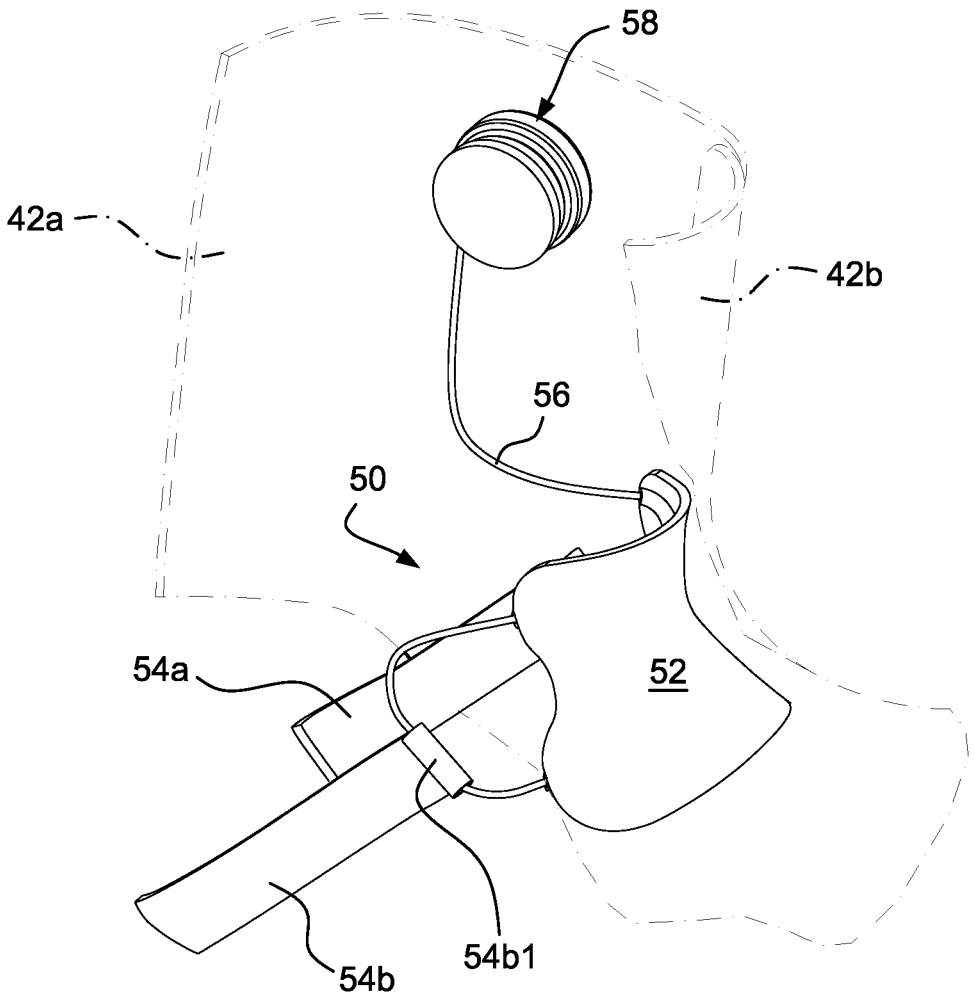
Figure 13:
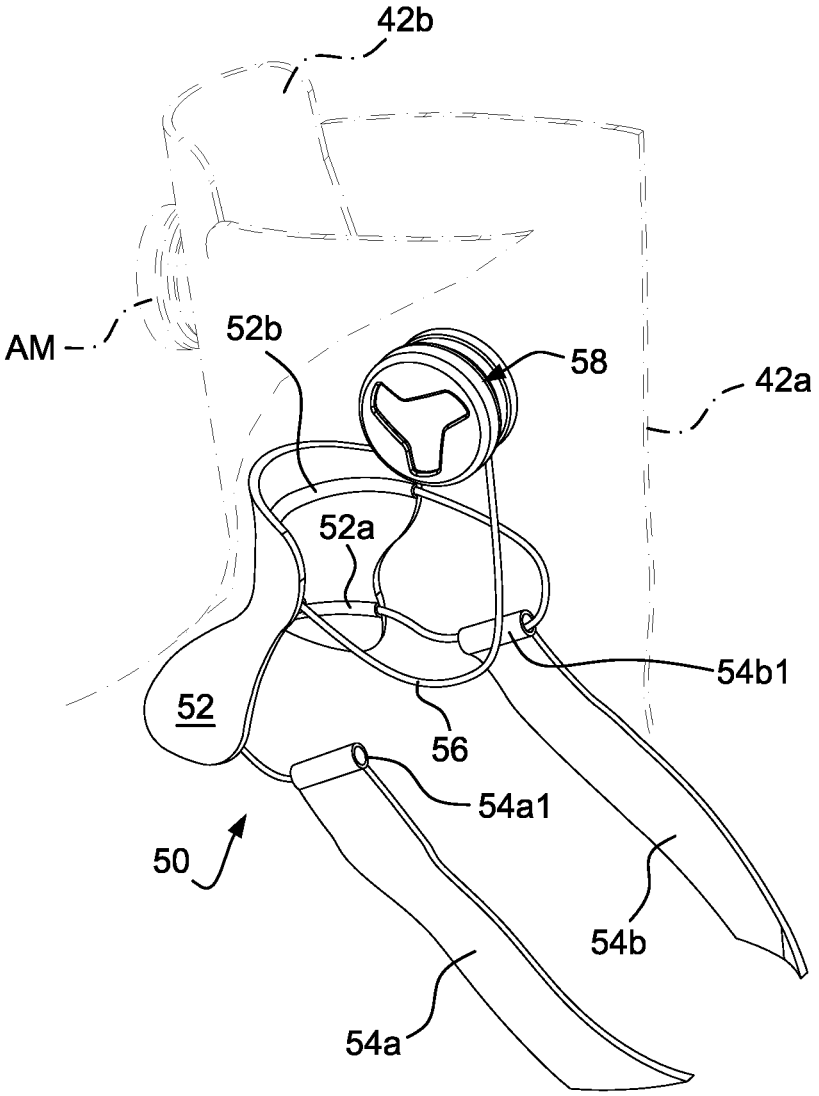
Figure 14:
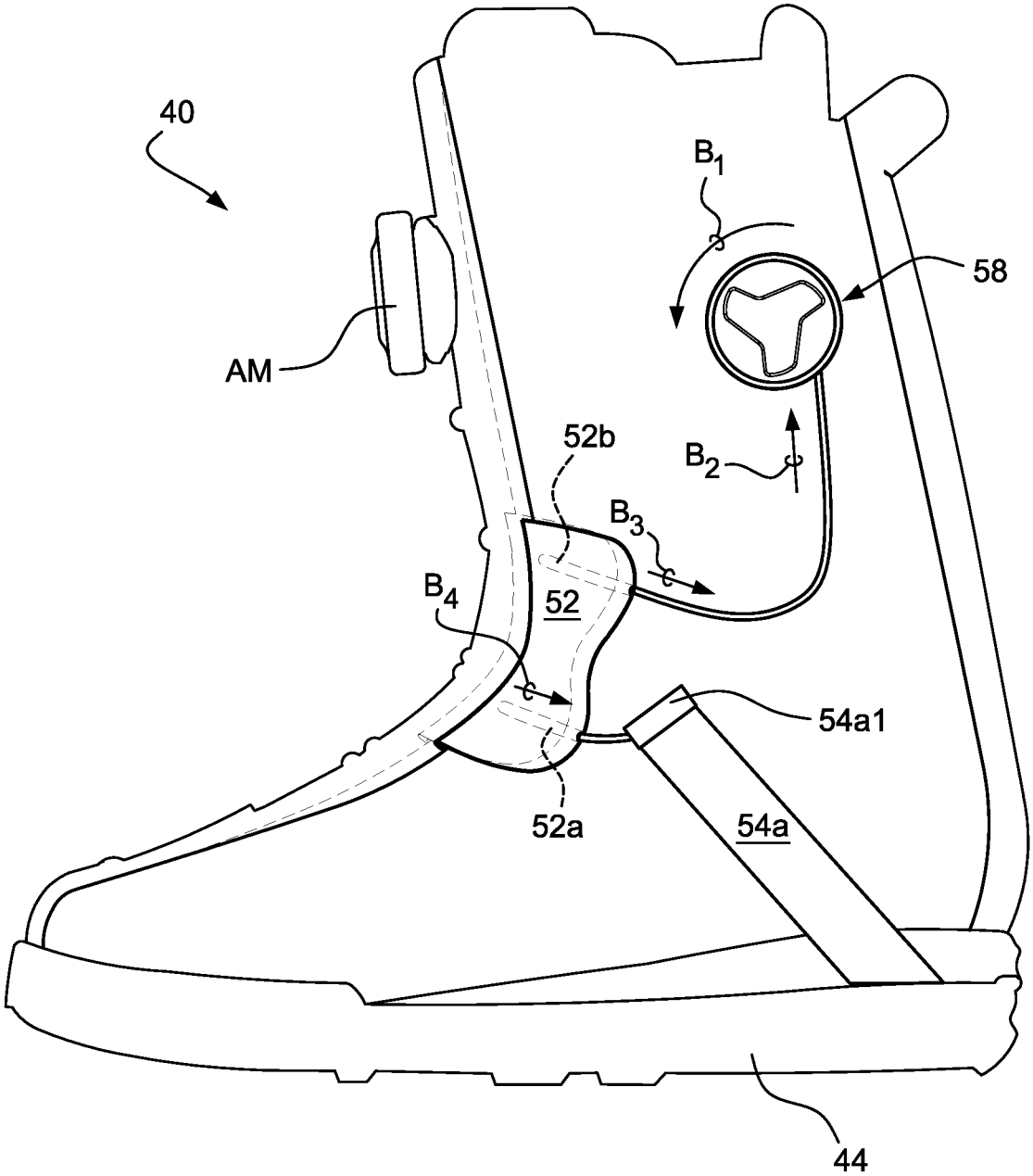
Figure 15:
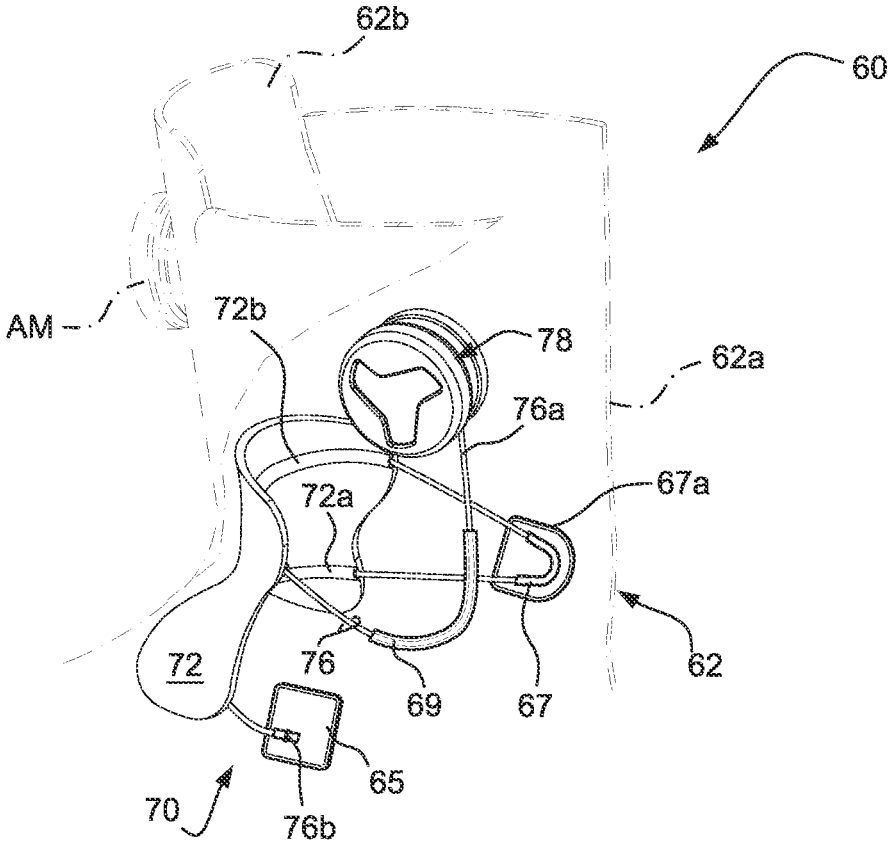
Figure 16:
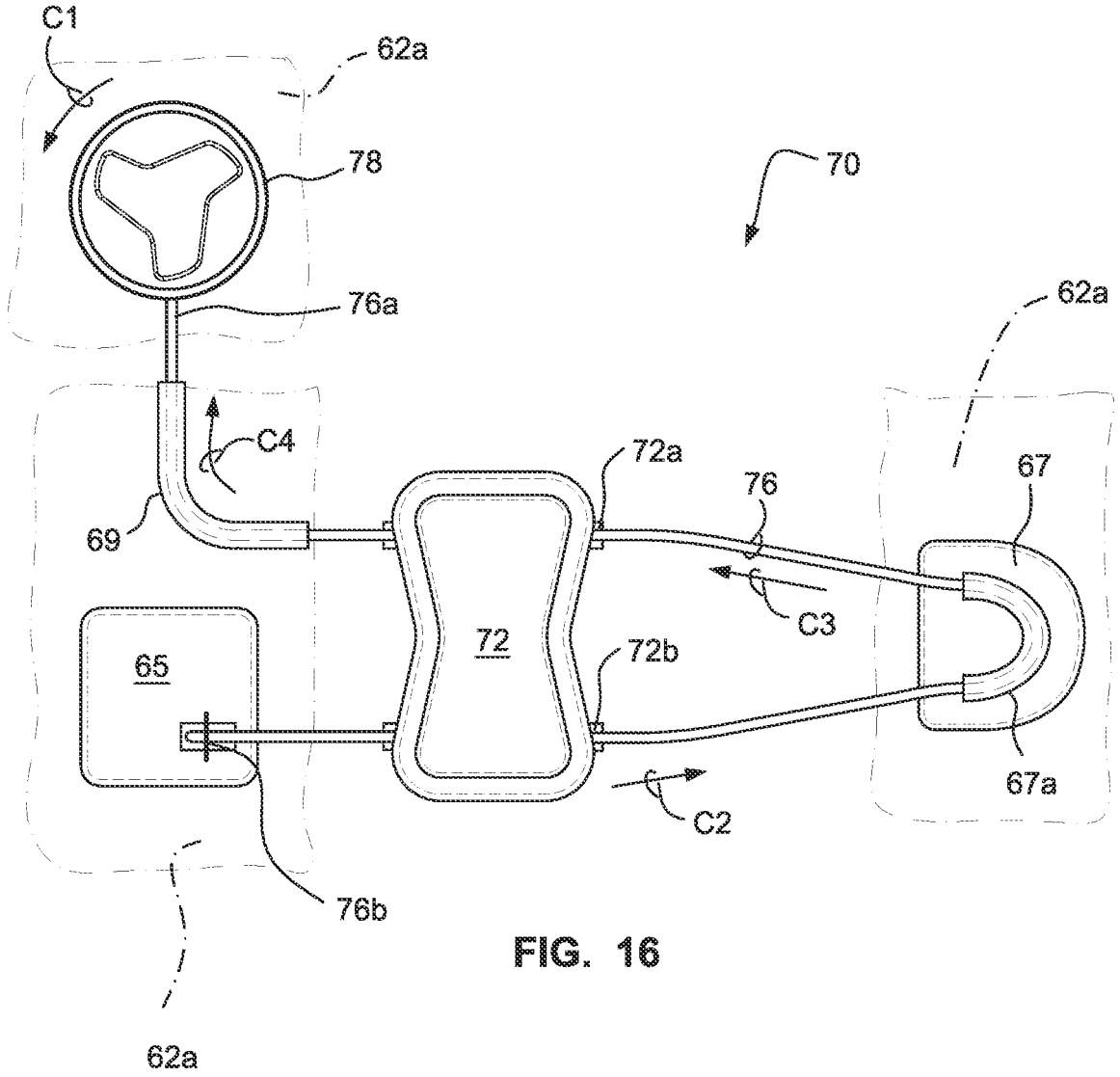

FIG. 12 is a medial front side perspective view shown slightly from above of the ankle compression system associated with the embodiment of FIG. 8 with the outer shell of the boot removed for clarity of illustration; and FIG. 13 is a lateral rear side perspective view of the ankle compression system associated with the embodiment of FIG. 8 with the outer shell of the boot removed for clarity of illustration;

FIG. 14 is a lateral side elevational view of the sport boot similar to FIG. 11 showing the manner in which the ankle compression system thereof operates in use;

FIG. 15 is a lateral rear side perspective view of the ankle compression system associated with another embodiment of the invention with the outer shell of the boot removed for clarity of illustration; and FIG. 16 is a schematic view of the ankle compression system employed in the embodiment depicted in FIG. 15.

DETAILED DESCRIPTION

Accompanying FIGS. 1-7 depict a sport boot 10 provided with an integrated ankle compression system 20 in accordance with a first embodiment of the herein disclosed invention. In this regard, it will be observed that the sport boot 10 is provided with an outer shell 12 connected to a sole 14. As is conventional, the upper shaft 12*a* of the outer shell 12 is open toward the front and includes a tongue 12*b* to close such opening. The outer shell 12 is sized and configured to removably accept therein a conventional boot liner BL (see FIG. 1) that may be worn by the user to thereby more easily facilitate the entry/exit of the boot by the user's foot.

Important to the embodiment shown in FIGS. 1-7, the sport boot 10 will include an ankle compression system 20 operatively attached to and positioned within the outer shell 12. The ankle compression system 20 will include a one-piece (unitary) ankle compression member 22 formed of a flexible or stretchable fabric or foam material having central compression region 22*a* which is sized and configured to cover an anterior portion of a user's ankle when positioned within the outer shell 12 of the boot 10. A lateral positioning band 22*b* extends rearwardly from a lateral end of central compression region 22*a*, while a pair of divergent upper and lower positioning bands 22*c*, 22*d* extend rearwardly from a medial end of the central compression region 22*a*. The ankle compression member 22 thereby forms a generally Y-shaped flexible structure. A flexible and stretchable fabric panel 24 may be positioned in the space defined between the divergent upper and lower positioning bands 22*c*, 22*d*.

Figure 1:
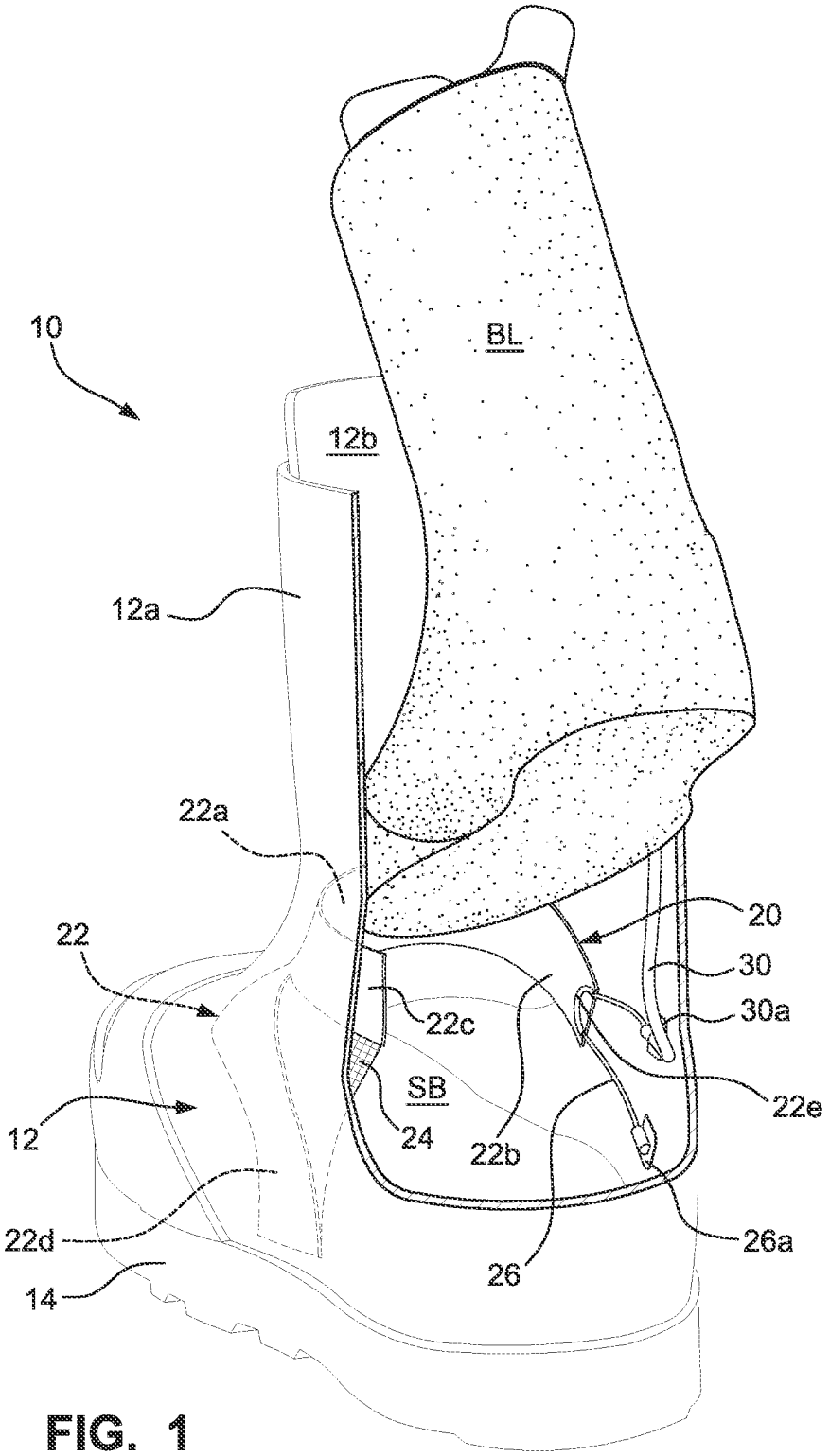
FIG. 1 is a rear medial side perspective view, partly in section, of a sport boot, e.g., a snowboarding boot, according to an embodiment of the invention disclosed herein showing the relationship between the outer shell of the boot provided with an integrated ankle compression system and a removable inner liner.
Figure 2:
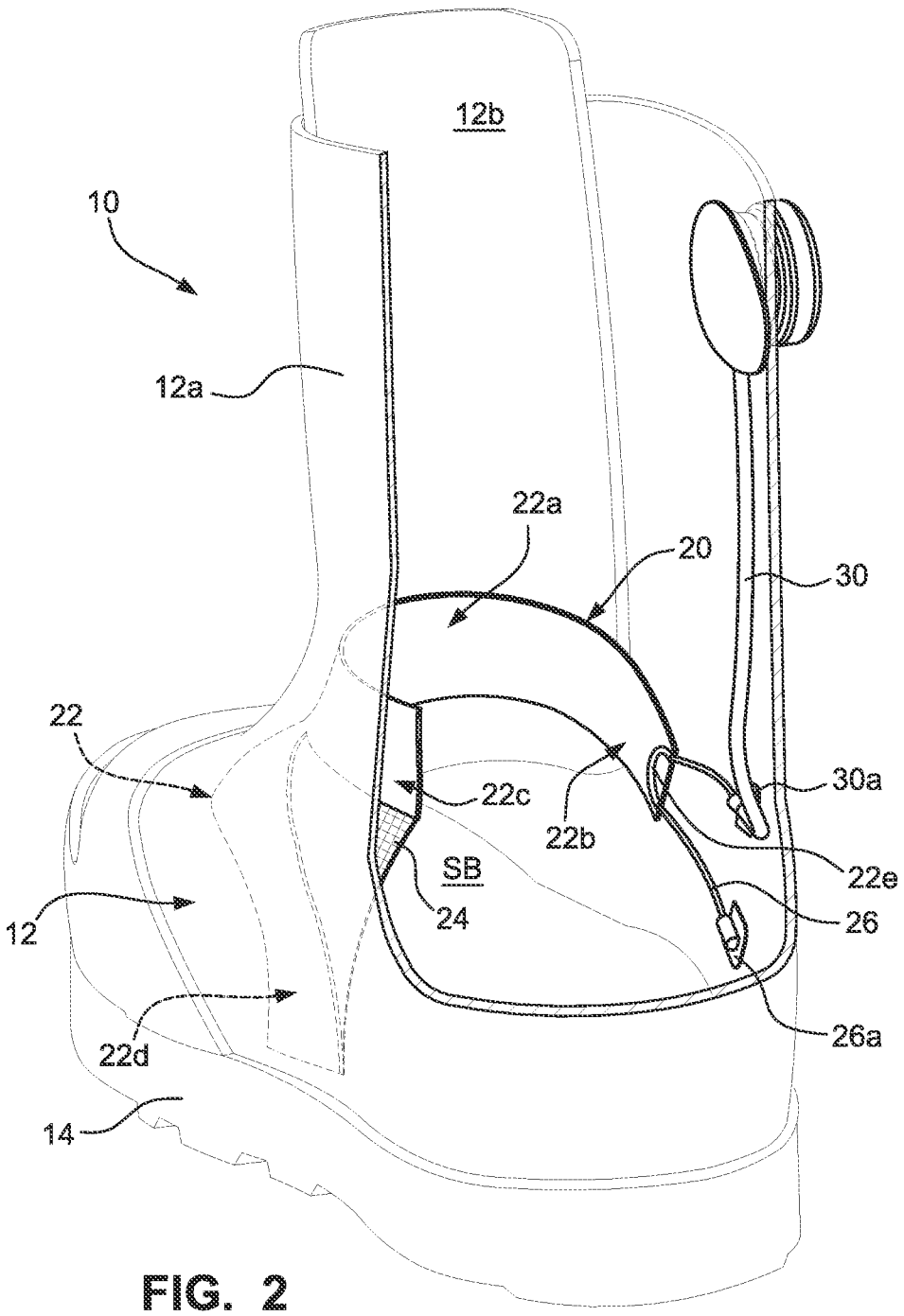
FIG. 2 is a rear medial side perspective view, partly in section, similar to FIG. 1 with the inner liner of the sport boot removed for clarity of illustration.
Figure 3:
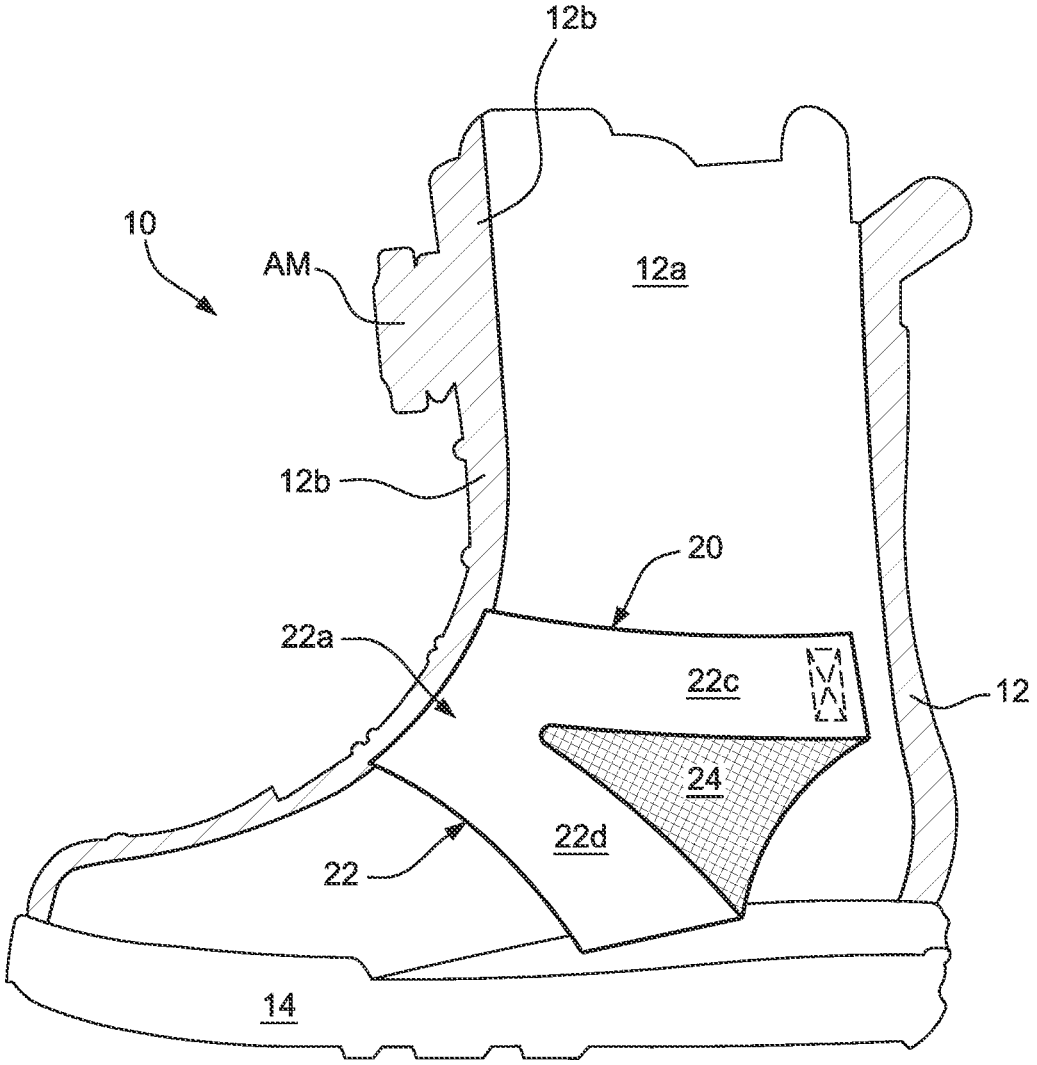
FIG. 3 is a medial side elevational view of the sport boot depicted in FIG. 1 with a portion of the medial side outer shell removed for clarity in showing a medial portion of the integrated ankle compression system thereof.
Figure 4:
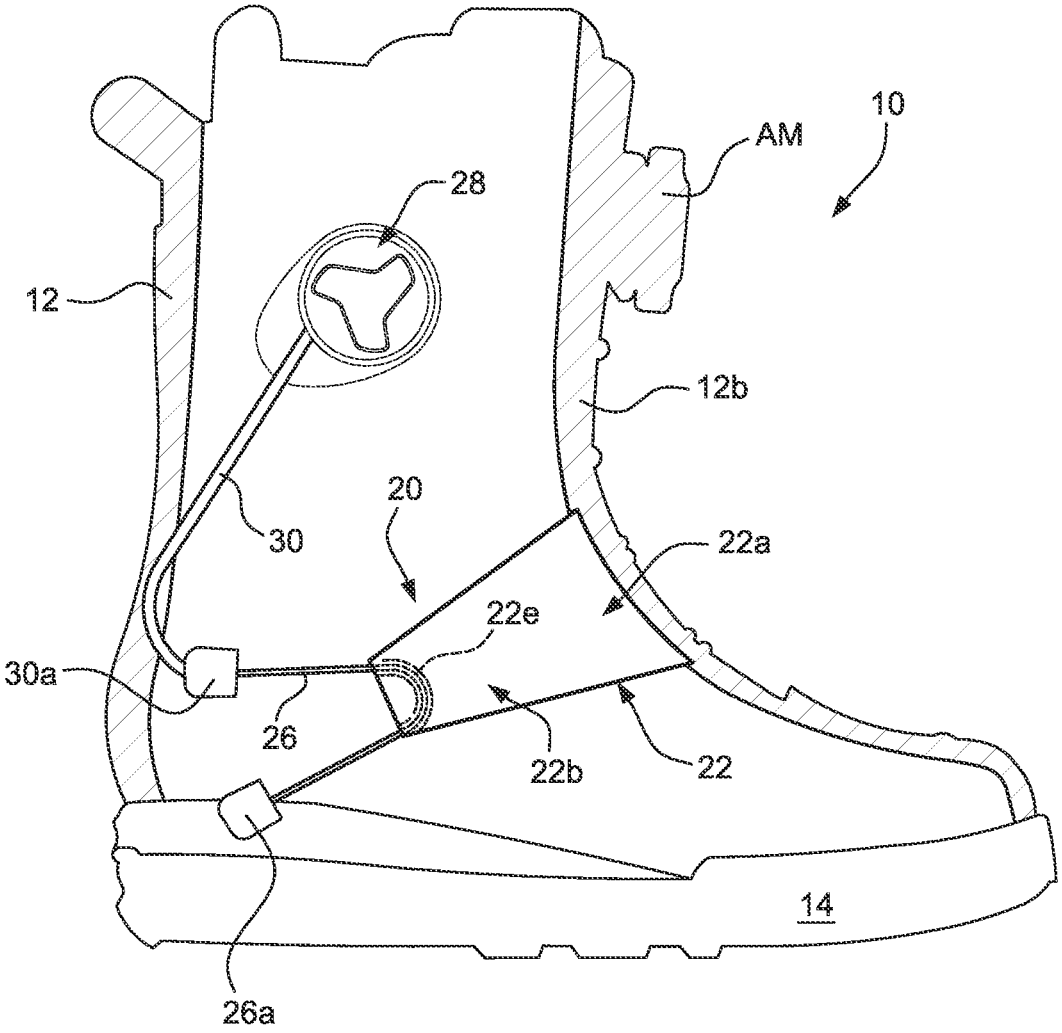
FIG. 4 is a lateral side elevational view of the sport boot depicted in FIG. 1 with a portion of the lateral side outer shell removed for clarity in showing a lateral portion of the integrated ankle compression system thereof.
Figure 5:
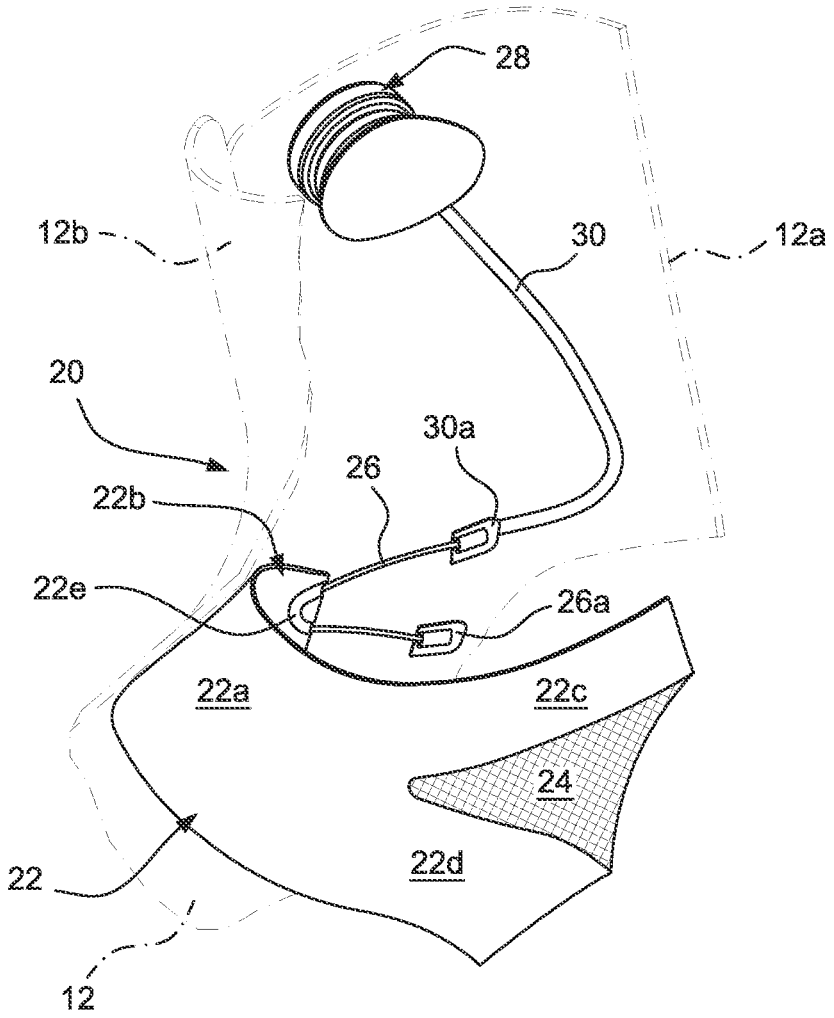
FIG. 5 is a medial side perspective view as seen from slightly above of the ankle compression system associated with the embodiment of FIG. 1 with the outer shell removed for clarity of illustration.
Figure 6:
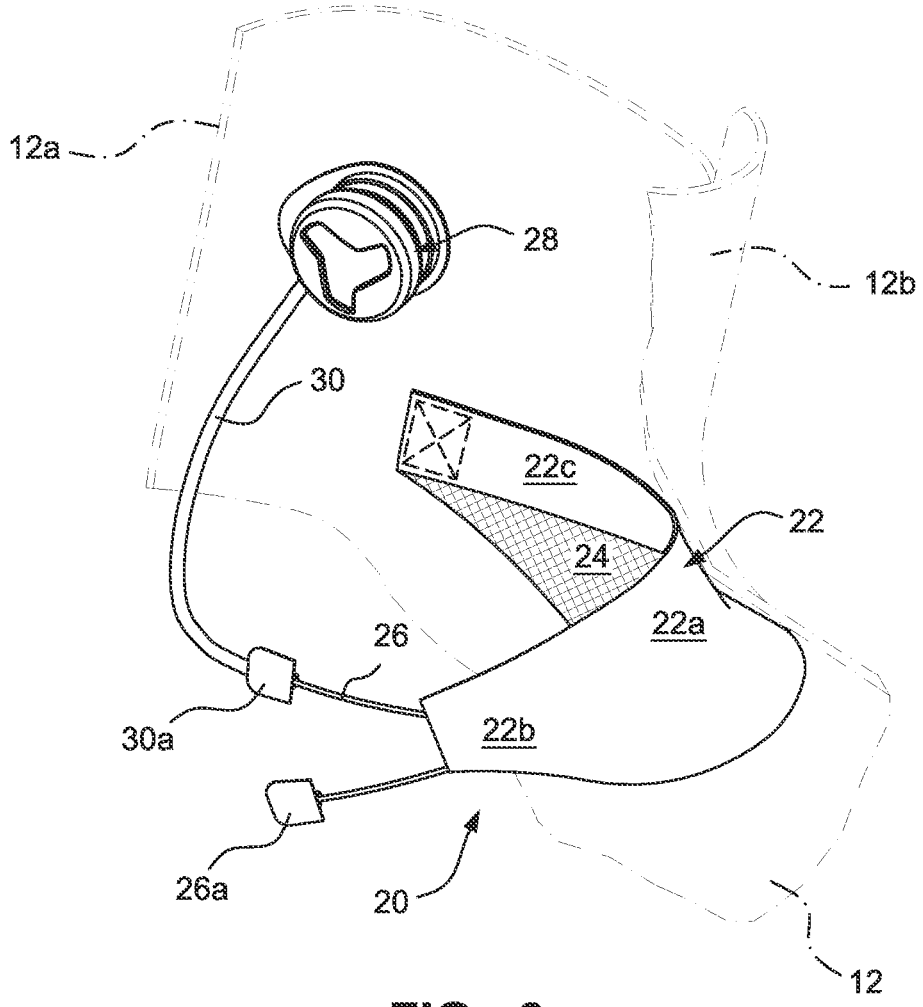
FIG. 6 is a lateral side perspective view as seen from slightly above of the ankle compression system associated with the embodiment of FIG. 1 with the outer boot shell removed for clarity of illustration.

The terminal end of the upper medially extending positioning band 22*c* is immovably fixed to an interior portion of the outer shell 12, e.g., by stitching, while the terminal end of the lower medially extending positioning band 22*d* is immovably fixed to a medial edge portion of the strobel SB (see FIGS. 1 and 2). It will be appreciated in this regard that boot 10 depicted in FIGS. 1-7 is for a user's right foot, however, the various structures and positions will similarly be present in a boot 10 for a user's left foot except in mirror image to the same.

The terminal end of the laterally extending positioning band 22*b* is itself unattached to the interior of the outer shell 12 but includes a U-shaped channel 22*e* which slideably receives therein a portion of an adjustment lace 26. The adjustment lace 26 may be formed of any cord material suitable use in the activities for which the boot 10 is designed. Thus, for example, the adjustment lace 26 may be a braided cord formed e.g., of polymeric or stainless steel monofilaments. A terminal end of the adjustment lace 26 is immovably fixed to an interior portion of the outer shell by a lace terminator 26*a* while an opposite end of the adjustment lace 26, after being routed through the U-shaped channel 22*e* of the ankle compression member 22 is operatively associated with a reel of a conventional tightening mechanism 28 such as described in U.S. Pat. No. 6,202,953 (the entire content of which is expressly incorporated hereinto by reference). An especially preferred tightening mechanism 28 are the cable tightening reels associated with the BOA® fit system commercially available from BOA® of Steamboat Springs, Colorado. The adjustment lace 26 is slideably positioned within a tube 30 having an upper end operatively associated with the adjustment mechanism 28 and a lower end fixed to an interior of the outer shell by a tube guide 30*a*.

Figure 7:
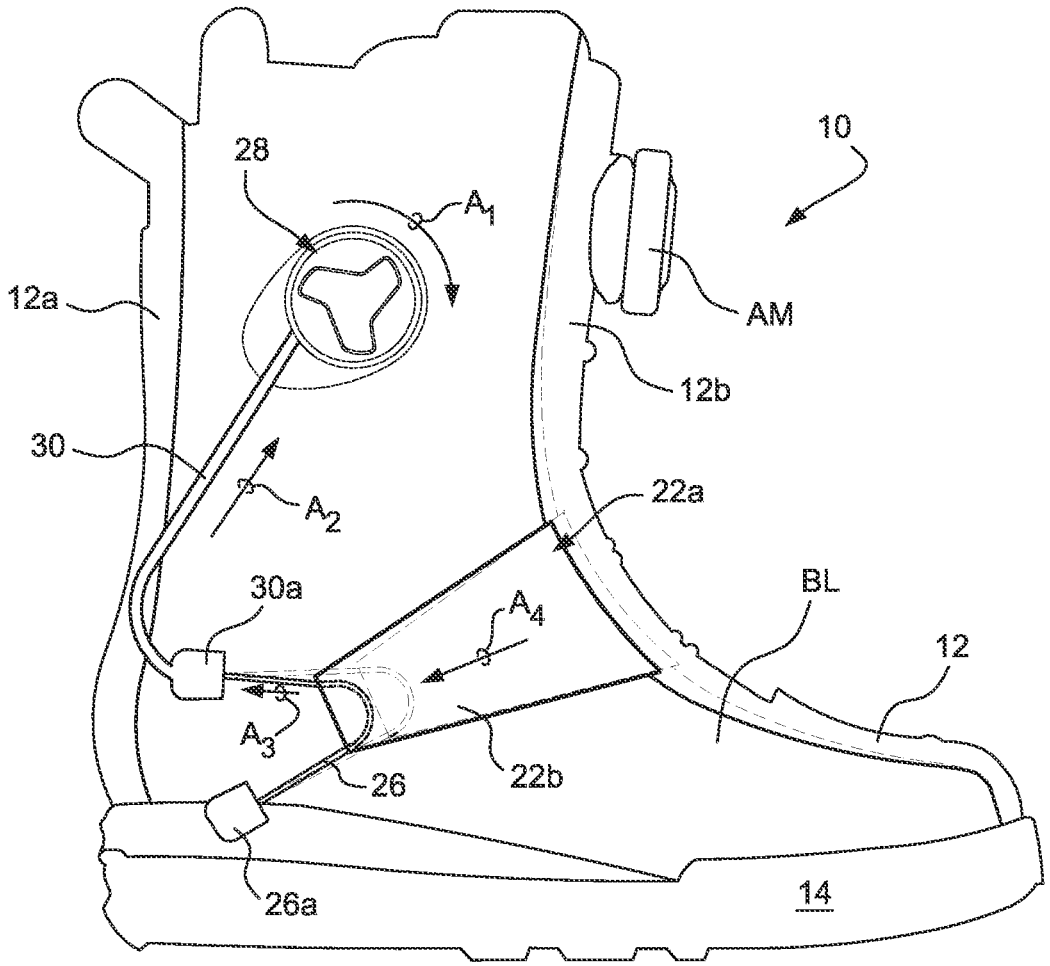
FIG. 7 is a lateral side elevational view of the sport boot similar to FIG. 4 showing the manner in which the ankle compression system thereof operates in use.

In use, with specific reference to FIG. 7, a user's foot wearing the boot liner BL may be inserted into the boot 10 with the adjustment mechanism in non-tightened state. Such a state will therefore allow the user to easily slide the boot liner BL into a comfortable position within the interior of the outer shell 12. Thereafter, the user may turn the adjustment mechanism 28, e.g., in the direction of arrow A1 to cause the adjustment lace 26 to be drawn into the adjustment mechanism 28 through the tube 30 in the direction of arrow A2. This movement of the adjustment lace 26 will in essence shorten its effective length thereby causing the terminal end of lateral positioning band 22*b* to be drawn rearwardly (arrow A3) which in turn will cause the ankle compression member 22 to be drawn downwardly and rearwardly (arrow A4) against an anterior portion of the user's ankle within the boot liner BL exerting compressive pressure thereagainst. The user may thus continue to turn the adjustment mechanism 28 until the desired amount of compressive pressure against the anterior ankle portion has been achieved. Thereafter, a secondary adjustment mechanism AM associated with the tongue 12*b* and operatively engaged with external boot laces (not shown) at the forward opening of the upper shaft 12*a* may be operated so as to finish the boot closure. When it is desired to remove the outer shell 12 of the boot 10, the operation as described above may be reversed.

Accompanying FIGS. 8-14 depict a sport boot 40 provided with an integrated ankle compression system 50 in accordance with a second embodiment of the herein disclosed invention. It will be appreciated that boot 40 depicted in FIGS. 8-14 is for a user's left foot, however, the various structures and positions will similarly be present in a boot 40 for a user's right foot except in mirror image to the same.

It will be observed that, like the embodiment described above with regard to the sport boot 10, the sport boot 40 is provided with an outer shell 42 connected to a sole 44. As is conventional, the upper shaft 42*a* of the outer shell 42 is open toward the front and includes a tongue 42*b* to close such opening. The outer shell 42 is sized and configured to removably accept therein a conventional boot liner, e.g., such as the boot liner BL (see FIG. 1) described above that may be worn by the user to thereby more easily facilitate the entry/exit of the boot by the user's foot.

Important to the embodiment shown in FIGS. 8-14, the sport boot 40 will include an ankle compression system 50 operatively attached to and positioned within the outer shell 42. The ankle compression system 40 will includes an ankle compression member 52 formed of a flexible or stretchable fabric or foam material which is generally centrally located so as to be positioned forwardly adjacent an anterior portion of the user's ankle portion when the user's foot is comfortably wearing the boot 40.

Lateral and medial positioning bands 54*a*, 54*b*, respectively, are attached to an interior portion of the outer shell 42 and extend downwardly and rearwardly from the ankle compression member 52. More specifically, each of the lateral and medial positioning bands 54*a*, 54*b* will include a lower end which is immovably fixed to lateral and medial edge portions, respectively, of the strobel SB (see FIGS. 8 and 9). The lateral and medial positioning bands 54*a*, 54*b*, respectively, will thus extend upwardly and forwardly along respective lateral and medial interior surfaces of the outer shell 42 and terminate at an upper end positioned adjacent to but spaced from a side edge of the ankle compression member 52. The lateral and medial positioning bands 54*a*, 54*b* may be affixed to an interior portion of the upper shell 12 by any suitable means, e.g., stitching and/or gluing.

The upper terminal ends of the lateral and medial positioning bands 54*a*, 54*b* include eyelet channels 54*a*1, 54*b*1, respectively, that are joined to the ankle compression member 52 by an adjustment lace 56. In this regard, it will be observed that a lower end of the adjustment lace 56 is immovably fixed to the eyelet channel 54*a*1 at the upper end of the lateral positioning band 54*a* and is routed within a lower channel 52*a* formed in the ankle compression member 52 so as to be slideably inserted through the eyelet channel 54*b*1 at the upper end of the opposing medial positioning band 54*b*. The adjustment lace 56 is then doubled back from the upper end of the medial positioning band 54*b* and routed within an upper channel 52*b* formed in the ankle compression member 52 such that an upper end of the adjustment lace 56 is operably connected to the tightening mechanism 58. It will be appreciated that the adjustment lace 56 is slideably positioned within and through the upper and lower guide channels 52*a*, 52*b* as well as the eyelet channel 54*b*1 at the upper end of the medial positioning band 54*b* and may be guided to the tightening mechanism 58 via guide tubes or channels (not shown) positioned on an interior of the outer shell 42.

In use, with specific reference to FIG. 14, a user's foot wearing the boot liner BL may be inserted into the boot 40 with the adjustment mechanism 58 in non-tightened state. Such a state will therefore allow the user to easily slide the boot liner BL into a comfortable position within the interior of the outer shell 42. Thereafter, the user may turn the adjustment mechanism 58, e.g., in the direction of arrow B1 to cause the adjustment lace 56 to be drawn into and toward the adjustment mechanism 58 in the direction of arrows B2 and B3. This movement of the adjustment lace 56 will in essence shorten its effective length thereby causing the ankle compression member 52 to be urged downwardly and rearwardly (arrow B4) against an anterior portion of the user's ankle within the boot liner BL exerting compressive pressure thereagainst. The user may thus continue to turn the adjustment mechanism 58 until the desired amount of compressive pressure against the anterior ankle portion has been achieved. Thereafter, a secondary adjustment mechanism AM associated with the tongue 42*b* and operatively engaged with external boot laces (not shown) at the forward opening of the upper shaft 42*a* may be operated so as to finish the boot closure. When it is desired to remove the outer shell 42 of the boot 40, the operation as described above may be reversed.

Accompanying FIGS. 15 and 16 depict a sport boot 60 provided with an integrated ankle compression system 70 in accordance with a further embodiment of the herein disclosed invention. It will be appreciated in this regard that that boot 60 depicted in FIGS. 15 and 16 is for a user's left foot, however, as was noted hereinabove the various structures depicted in such Figures will similarly be present in a boot 60 for a user's right foot except in mirror image to the same.

It will be observed that, like the embodiments described above with regard to the sport boots 10 and 40, the sport boot 60 is provided with an outer shell 62 connected to a sole (not shown in FIG. 15). As is conventional, the upper shaft 62*a* of the outer shell 62 is open toward the front and includes a tongue 62*b* to close such opening. The outer shell 62 is sized and configured to removably accept therein a conventional boot liner, e.g., such as the boot liner BL (see FIG. 1) described above that may be worn by the user to thereby more easily facilitate the entry/exit of the boot by the user's foot.

Important to the embodiment shown in FIGS. 15 and 16, the sport boot 60 will include an ankle compression system 70 operatively attached to and positioned within the outer shell 62. The ankle compression system 70 will includes an ankle compression member 72 formed of a flexible or stretchable fabric or foam material which is generally centrally located so as to be positioned forwardly adjacent an anterior portion of the user's ankle portion when the user's foot is comfortably wearing the boot 60. The inner surface of the ankle compression member 72 is provided with upper and lower generally horizontally disposed guide channels 72*a*, 72*b*.

An adjustment lace 76 is operably connected at its upper end 76*a* to a rotary tightening mechanism 78 such as described in the above-noted U.S. Pat. No. 6,202,953 (e.g., a cable tightening reel associated with the BOA® fit system commercially available from BOA® of Steamboat Springs, Colorado) and is positionally fixed to the interior surface of the outer shell 62 at its lower end 76*b* by means of an anchor pad 65.

As will be observed, the tightening mechanism 78 and the anchor pad 65 are positioned on the lateral side of the upper shaft 62*a* of the outer shell 62 with the latter being positioned below the former. A generally U-shaped guide tube 67 is fixed to a patch panel 67*a* which itself is positioned on the interior surface of the outer shell 62 on the medial side of the upper shaft 62*a* generally opposite the anchor pad 65. A further intermediate guide tube 69 is physically attached to an interior surface of the outer shell 62 above the anchor pad 65. The adjustment lace 76 will thus be routed from its upper end 76*a* operably attached to the tightening mechanism 78 sequentially through the intermediate guide tube 69, the upper guide channel 72*a* associated with the ankle compression member 72, the U-shaped guide tube 67*a* associated with the anchor pad 67 at the medial side of the outer shell 62, through the lower guide channel 72*b* associated with the ankle compression member 72 and then to the anchor pad 65 where the end 76*b* is positionally fixed at the lateral side of the outer shell 62.

In use, with specific reference to FIG. 16, a user's foot wearing the boot liner BL (see FIG. 1) may be inserted into the boot 60 with the adjustment mechanism 78 in non-tightened state. Such a state will therefore allow the user to easily slide the boot liner BL into a comfortable position within the interior of the outer shell 62. Thereafter, the user may turn the adjustment mechanism 78, e.g., in the direction of arrow C1 to cause the adjustment lace 76 to be drawn into and toward the adjustment mechanism 78 in the direction of arrows C2, C3 and C4. This movement of the adjustment lace 76 will in essence shorten its effective length thereby causing the ankle compression member 72 to be urged downwardly and rearwardly against an anterior portion of the user's ankle within the boot liner BL thus exerting compressive pressure thereagainst. The user may continue to turn the adjustment mechanism 78 until the desired amount of compressive pressure against the anterior ankle portion has been achieved. Thereafter, a secondary adjustment mechanism AM associated with the tongue 62*b* and operatively engaged with external boot laces (not shown) at the forward opening of the upper shaft 62*a* may be operated so as to finish the boot closure. When it is desired to remove the outer shell 62 of the boot 60, the operation as described above may be reversed.

While reference is made to a particular embodiment of the invention, various modifications within the skill of those in the art may be envisioned. Therefore, it is to be understood that the invention is not to be limited to the disclosed embodiments, but on the contrary, is intended to cover various modifications and equivalent arrangements included within the spirit and scope thereof.

What is claimed is:

1. A sport boot comprising:

an outer shell;

a strobel affixed to the outer shell; and an ankle compression system attached to and positioned within the outer shell to apply selective compressive force against an anterior ankle portion of a person's foot when wearing the sport boot, wherein the ankle compression system comprises:

(a) a generally Y-shaped ankle compression member formed of a flexible material and adapted to be positioned forwardly adjacent the anterior ankle portion of the person's foot when wearing the sport boot, the ankle compression member including:

(i) a central compression region which includes lateral and medial ends and which is sized and configured to cover the anterior ankle portion of the person's foot when wearing the sport boot;

(ii) a lateral positioning band which extends rearwardly from the lateral end of the central compression region and having a lateral terminal end which is unconnected to an adjacent lateral interior portion of the outer shell;

(iii) upper and lower medial positioning bands connected to and extending divergently rearwardly from the medial end of the central compression region, wherein a terminal end of the lower medial positioning band is immovably fixed to a medial edge portion of the strobel, and wherein a terminal end of the upper medial positioning band is immovably fixed to an adjacent medial interior portion of the outer shell; and (iv) an adjustment lace connected operatively to the lateral terminal end of the lateral positioning band of the ankle compression member; and wherein the ankle compression system further comprises:

(b) a tightening member positioned on a lateral side of the outer shell and connected to the adjustment lace, the tightening member being operable to cause the adjustment lace to forcibly draw the ankle compression member toward and exert a selective compressive force against the anterior ankle portion of the person's foot when wearing the sport boot.

2. The sport boot according to claim 1, wherein the central compression region, the upper and lower medial positioning bands and the lateral positioning band, and the upper and lower medial positioning bands are formed as a one-piece flexible material structure.

3. The sport boot according to claim 1, further comprising a fabric panel attached to and between the upper and lower medial positioning bands.

4. The sport boot according to claim 1, wherein the lateral terminal end of the lateral positioning band includes a U-shaped channel in which the adjustment lace is slideably received.

5. The sport boot according to claim 4, wherein the ankle compression system further comprises a lace terminator immovably fixed to an interior portion of the outer shell, wherein a terminal end of the adjustment lace is attached to the lace terminator.

6. The sport boot according to claim 5, wherein the ankle compression system further comprises a tube guide fixed to an interior portion of the upper shell in spaced relationship above the lace terminator for slideably receiving the lace therewithin.

7. The sport boot according to claim 6, wherein the ankle compression system further comprises a tube extending between the tube guide and the tightening member for slideably receiving the lace therewithin.

* * * * *